US006736262B2

(12) United States Patent
Focke et al.

(10) Patent No.: US 6,736,262 B2
(45) Date of Patent: May 18, 2004

(54) FLIP TOP BOX FOR CIGARETTES

(75) Inventors: Heinz Focke, Verden (DE); Henry Buse, Visselhövede (DE); Gisbert Engel, Kirchlinteln-Luttum (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 10/323,843

(22) Filed: Dec. 20, 2002

(65) Prior Publication Data

US 2003/0089628 A1 May 15, 2003

Related U.S. Application Data

(62) Division of application No. 09/787,022, filed on Mar. 13, 2001, now Pat. No. 6,513,651.

(51) Int. Cl.[7] ..... B65D 85/10
(52) U.S. Cl. ..... 206/268; 206/831
(58) Field of Search ..... 206/242, 264, 206/268, 269, 271, 273, 831, 232; 229/160.1, 70

(56) References Cited

U.S. PATENT DOCUMENTS

| | | | | |
|---|---|---|---|---|
| 4,620,664 A | | 11/1986 | Kaufman et al. | |
| 5,236,084 A | | 8/1993 | Evers | |
| 5,375,704 A | | 12/1994 | Focke et al. | |
| 5,715,936 A | | 2/1998 | Focke et al. | |
| 5,788,065 A | | 8/1998 | Focke | |
| 6,138,823 A | * | 10/2000 | Focke et al. | 206/268 |
| 6,164,444 A | * | 12/2000 | Bray et al. | 206/268 |
| 6,505,735 B1 | * | 1/2003 | Parker | 206/268 |
| 6,536,587 B2 | * | 3/2003 | Wachter | 206/268 |

FOREIGN PATENT DOCUMENTS

| | | |
|---|---|---|
| DE | 39 12 826 | 12/1989 |
| DE | 42 31 591 | 3/1994 |
| DE | 42 37 523 | 5/1994 |
| DE | 2 298 414 | 9/1996 |
| DE | 196 44 759 | 4/1998 |
| FR | 2 672 572 | 8/1992 |
| GB | 2 277 077 | 10/1994 |
| IT | 1273797 | 2/1994 |

OTHER PUBLICATIONS

[Press F11].

* cited by examiner

*Primary Examiner*—Luan K. Bui
(74) *Attorney, Agent, or Firm*—Sughrue Mion, PLLC

(57) ABSTRACT

The hinge-lid box is accompanied by a printing carrier or coupon (38), which is arranged within the hinge-lid box in a position which is favorable from the point of view of production and for handling the hinge-lid box. For this purpose, the coupon (38) has a leg (41) which is directed toward a lid front wall (17) on the inside. Said leg is in form-fitting engagement with a lid inner tab (39), which is likewise arranged on the inside of the lid front wall (17). When the lid (11) is opened, the coupon is partially pulled out of the hinge-lid box or of a box part (10) of the same.

8 Claims, 6 Drawing Sheets

Figure 1:
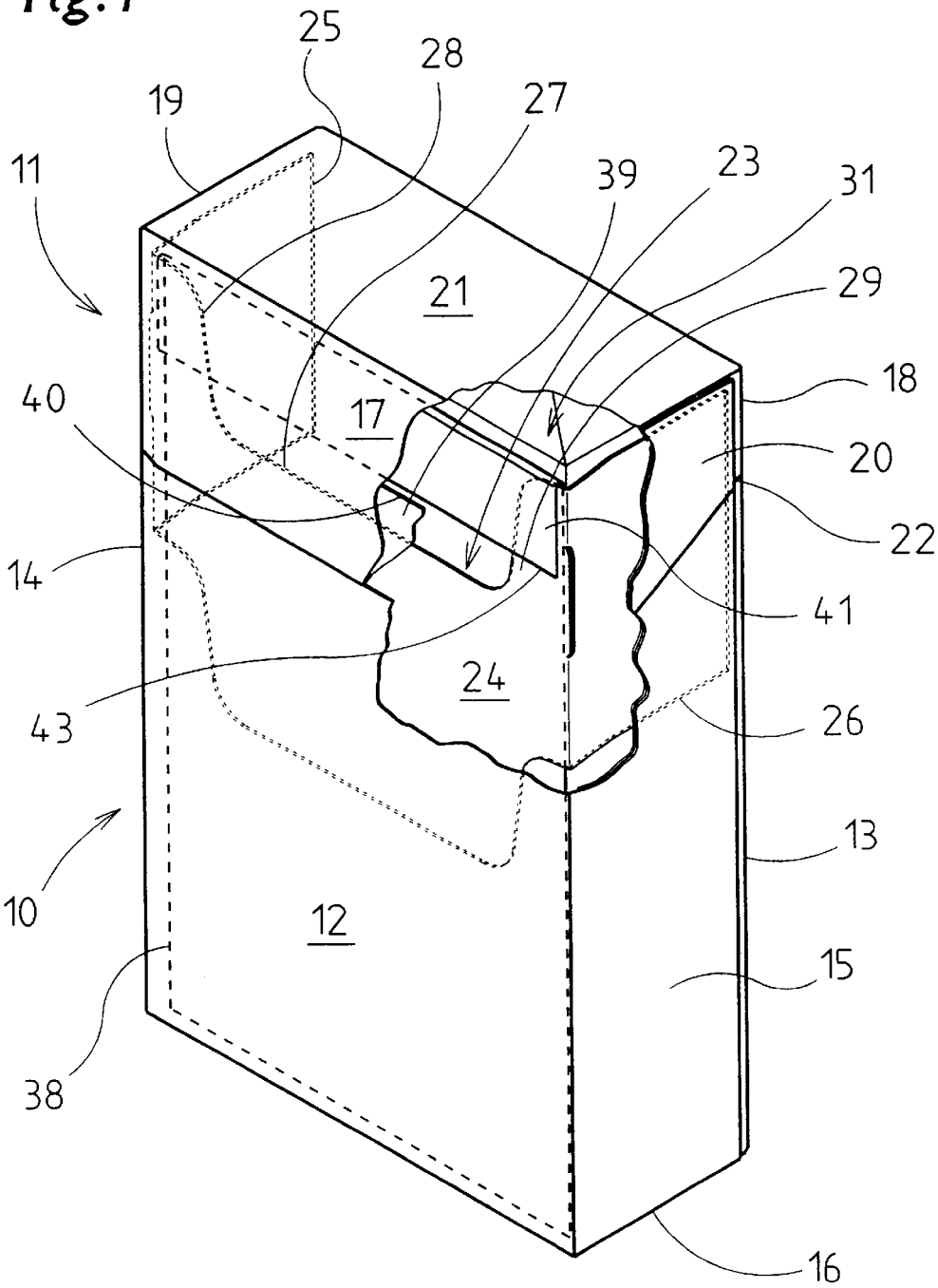

17
40
21
11
39
19
18
31
10
38
13
30
34
42
32
33
41
38
28/29
36
23
24
12
43

11
21
18
17
19
22
38
10
31
13
30
41
39
32
38
28/29
23
24
12

FLIP TOP BOX FOR CIGARETTES

This is a divisional of application Ser. No. 09/787,022 filed Mar. 13, 2001 (now U.S. Pat. No. 6 513.651), which is incorporated herein by reference.

DESCRIPTION

The invention relates to a pack with a lid, in particular a hinge-lid box for cigarettes, comprising a box part and lid connected pivotably thereto, a printing carrier or coupon comprising a separate blank being arranged, by way of a sub-region, namely by way of an anchoring element, in the lid.

There is an increasing need, in the configuration and production of cigarette packs for the addition of printing carriers or coupons as an additional advertising means, as a ticket for taking part in events, etc. The printing carriers or coupons are blanks made of thin material, in particular paper. Their positioning within the pack has to ensure easy access for the user, but also efficient industrial production of the packs.

A cigarette pack of the hinge-lid-box type in which a coupon or printing carrier is anchored in the lid of the hinge-lid box, between the end wall of the latter and inner lid corner tabs, is known.

The object of the invention is to propose packs with a lid, in particular hinge-lid boxes for cigarettes, in which printing carriers or coupons are arranged in a position which is favorable, in particular, for handling.

In order to achieve this object, the pack according to the invention is characterized in that the printing carrier or coupon has, in a region in the lid, a protrusion directed toward a lid front wall and the lid front wall has, on its inside, a mating protrusion which corresponds with the protrusion, and in that by interaction of the protrusion and mating protrusion, when the lid is opened, the printing carrier or coupon can be pulled out of the region of the box part.

An embodiment in which the printing carrier or coupon has a leg which is preferably formed by being folded over, is directed toward the lid front wall and of which the free leg border interacts in a form-fitting manner with a transverse edge of a lid inner tab is particularly advantageous.

Alternatively, the printing carrier/coupon may be connected to the lid front wall by adhesive bonding, preferably in the region of the leg directed toward the lid front wall. By virtue of the restoring forces of the material, the leg, when the pack is produced and/or the coupon is introduced, is forced against the inside of the lid front wall—above the correspondingly dimensioned lid inner tab—and connected to the lid front wall via glue.

A further special feature of the pack or hinge-lid box is that the printing carrier or the coupon is connected, preferably by easily releasable glue, to a flap of an inner wrapper of the cigarettes, said flap being conventional in hinge-lid boxes for cigarettes. The connection is configured such that either, by virtue of the flap being maneuvered, the printing carrier or coupon is pulled out of the pack or, by virtue of the printing carrier/coupon being gripped, the flap is torn off from the inner wrapper.

A pack with a coupon of the above type can be produced mechanically straightforwardly and efficiently, for example in accordance with DE 195 06 844.0.

Figure 3:
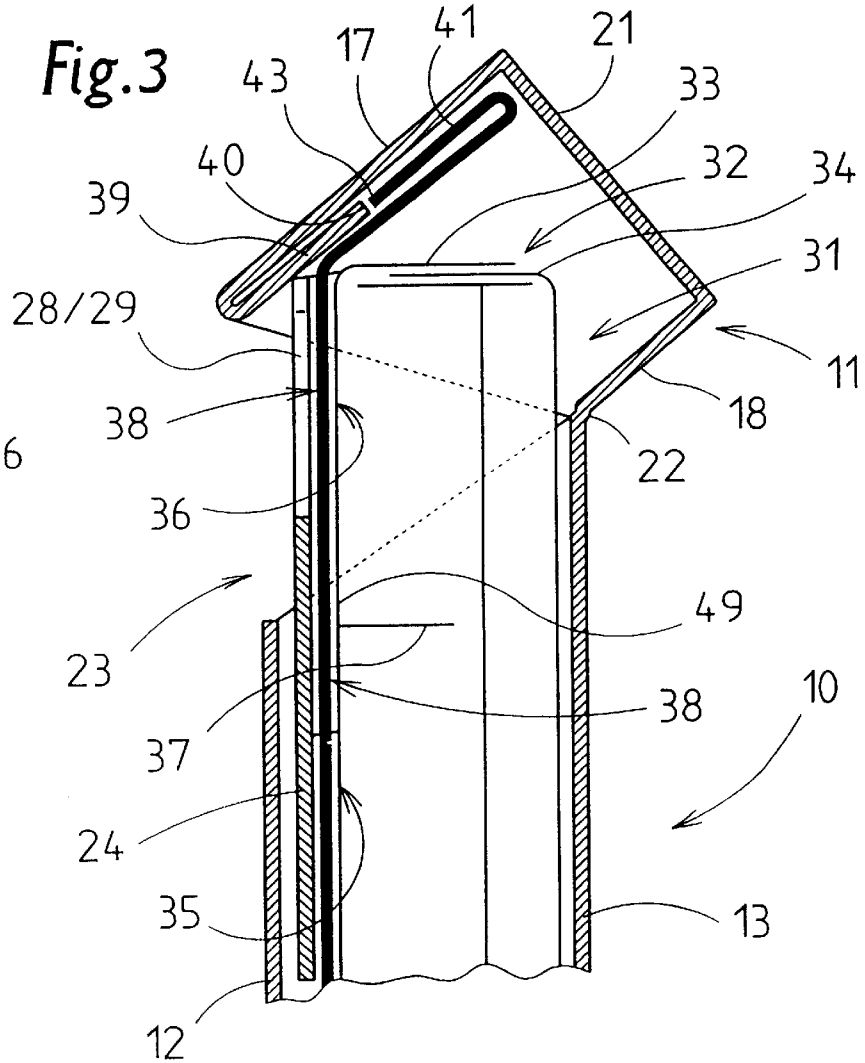
Figure 2:
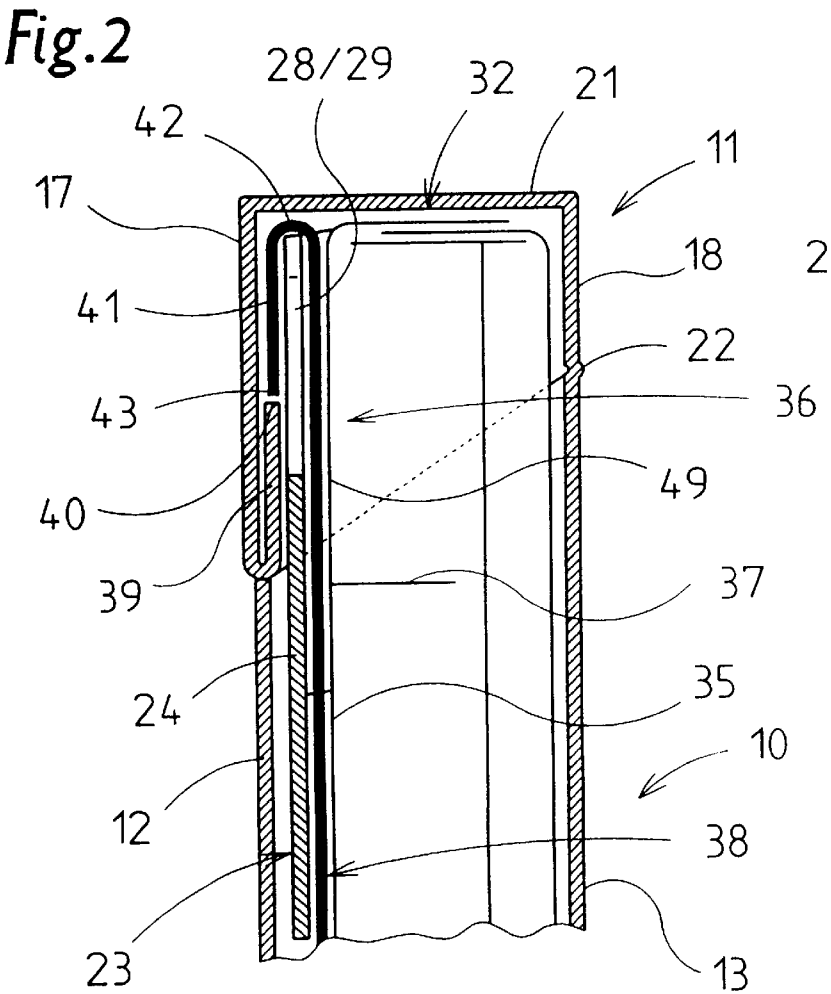
Figure 5:
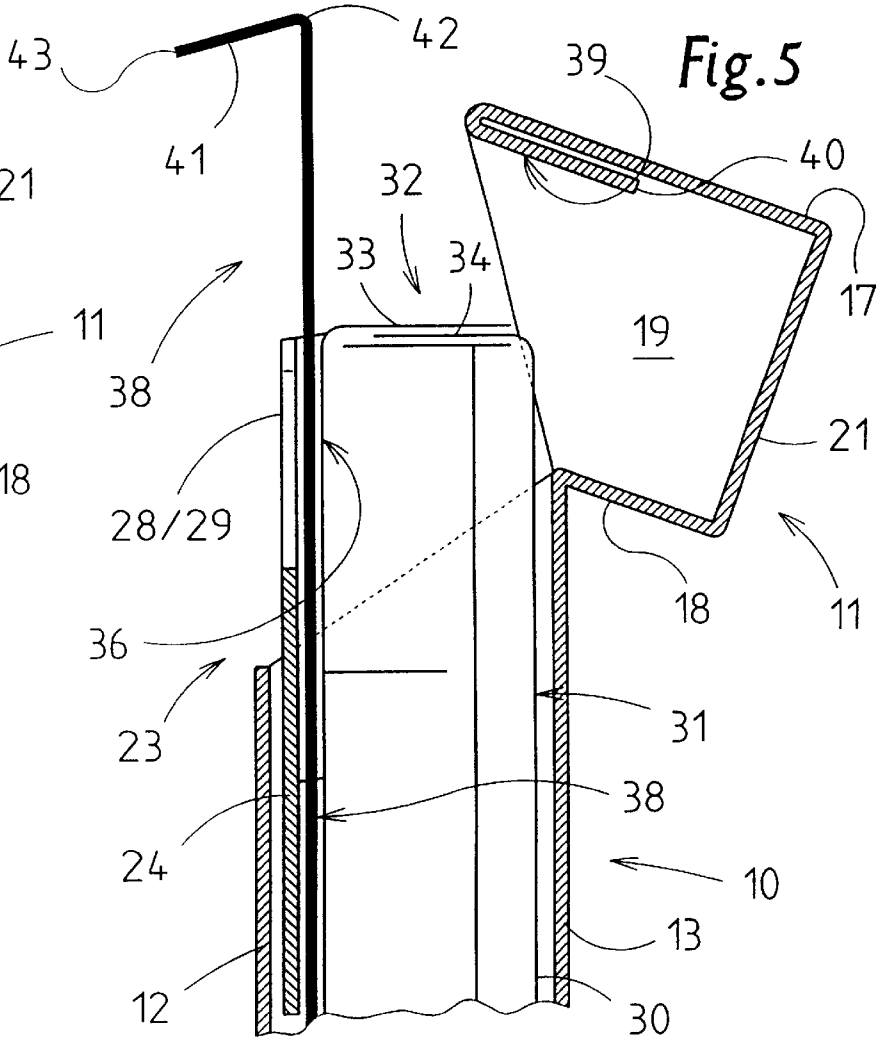
Figure 4:
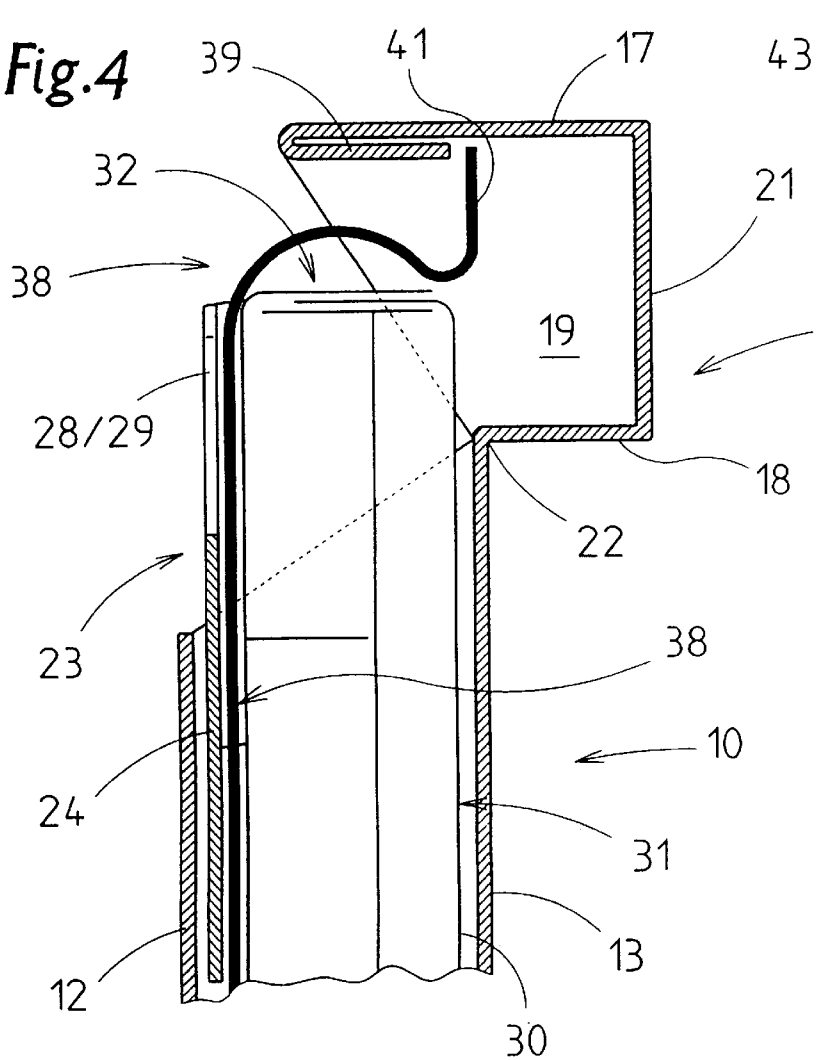
Figure 7:
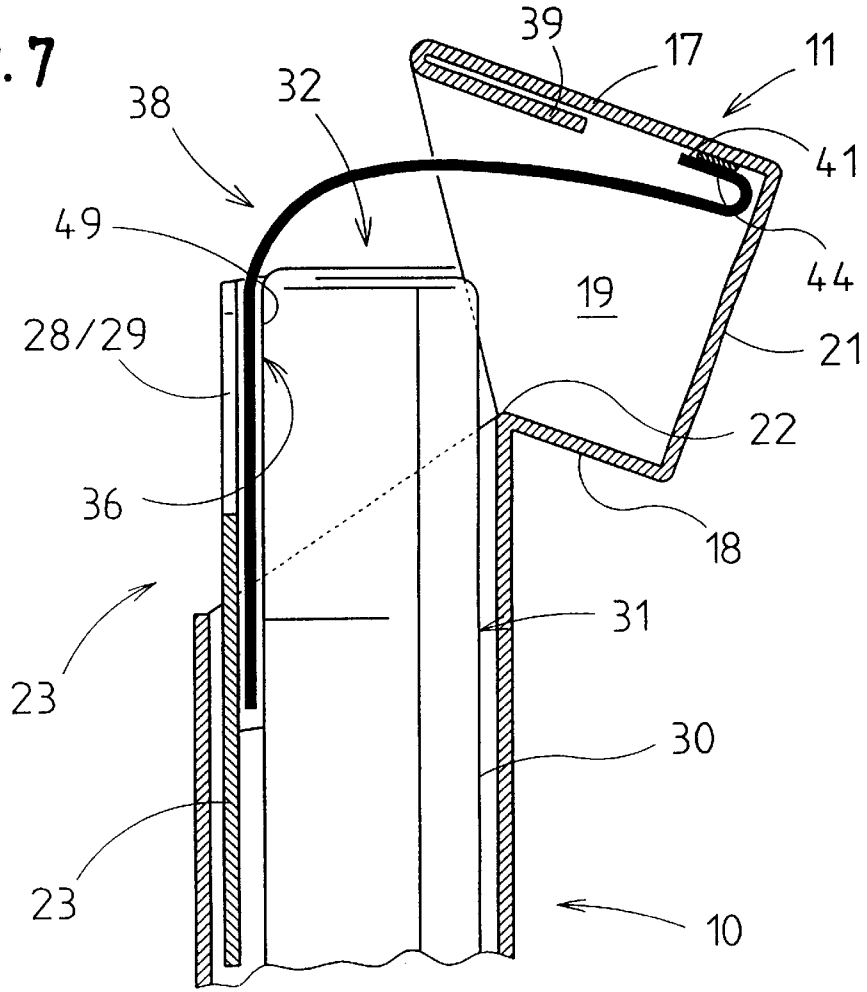
Figure 6:
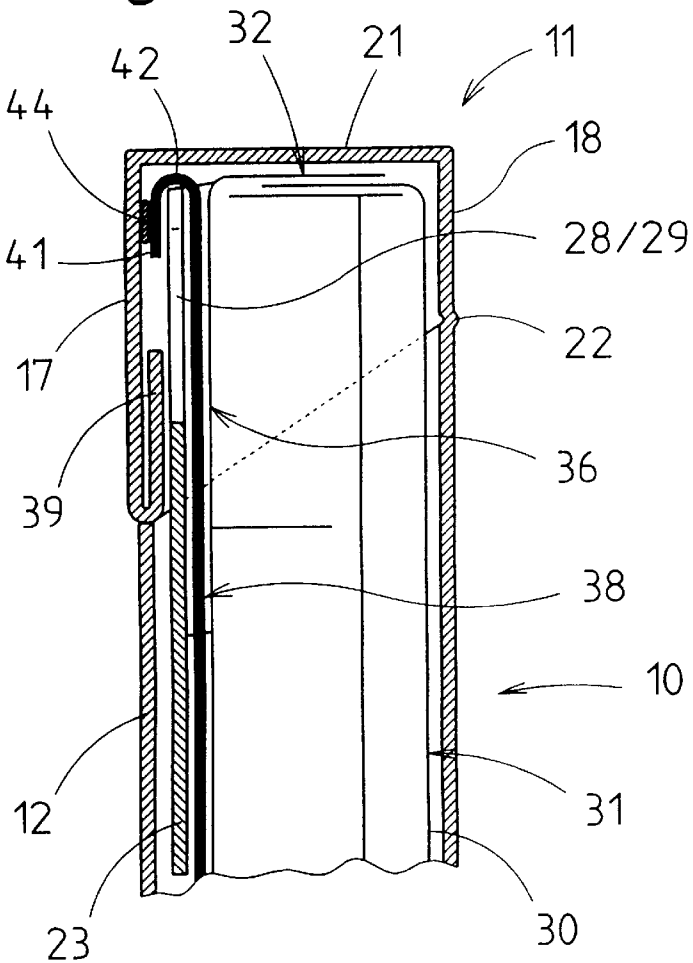
Figure 9:
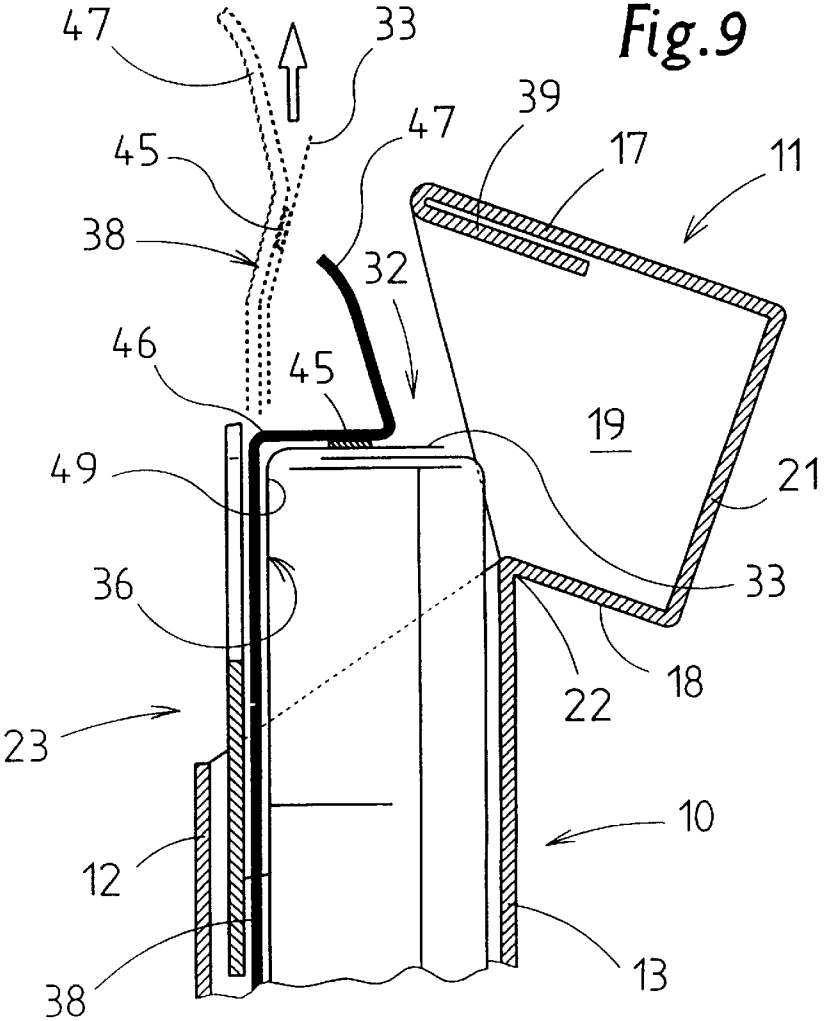
Figure 8:
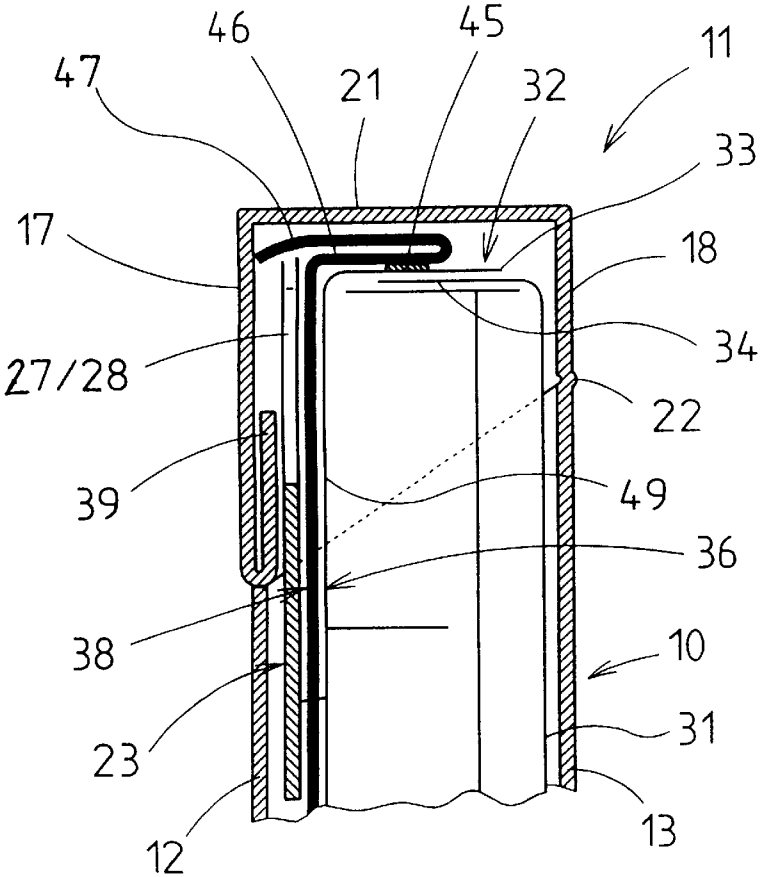
Figure 11:
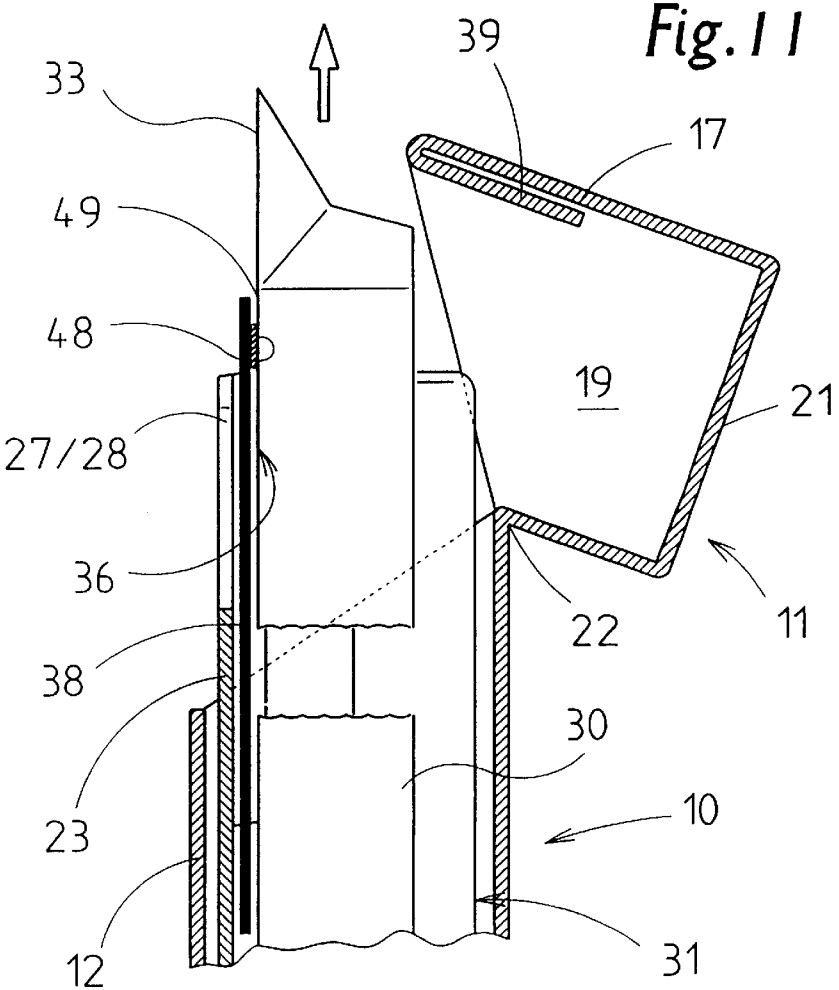
Figure 10:
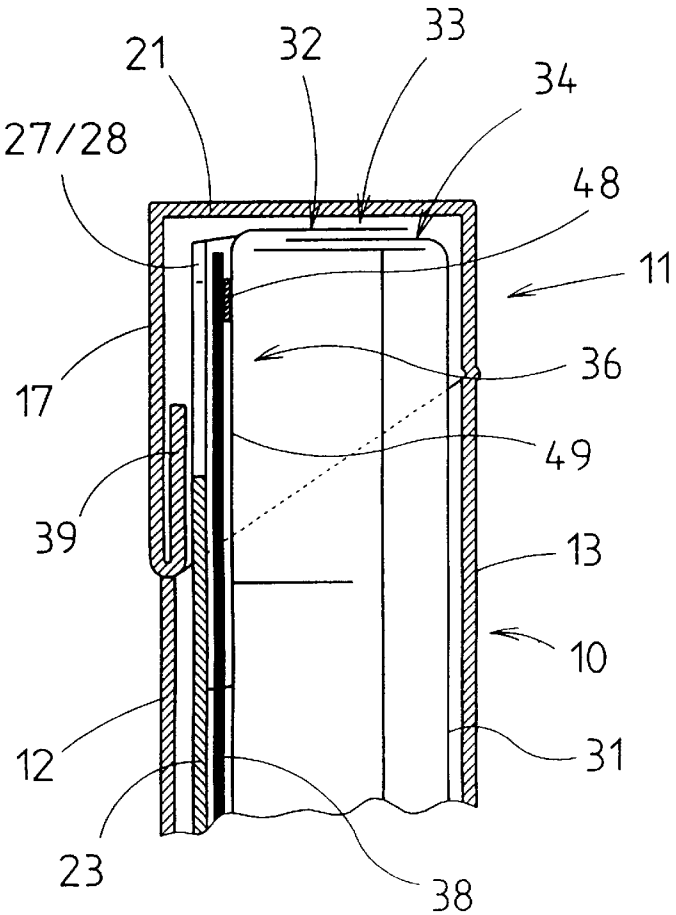

Further special features of the packs according to the invention are explained hereinbelow with reference to the drawings, in which:

FIG. 1 shows a perspective illustration of a hinge-lid box for cigarettes with a cut-out region, FIG. 2 shows, on an enlarged scale, a top region of a hinge-lid box in vertical section, FIG. 3 shows the detail according to FIG. 2 in a lid-opening phase, FIG. 4 shows an illustration relating to FIGS. 2 and 3 with the lid opened further, FIG. 5 shows an illustration corresponding to FIGS. 2 to 4 with the lid in the fully open state, FIG. 6 shows an illustration analogous to FIG. 2 for another exemplary embodiment of a hinge-lid box, FIG. 7 shows the hinge-lid box according to FIG. 6 in the open position, FIG. 8 shows an illustration analogous to FIG. 2 for a further exemplary embodiment of a hinge-lid box, FIG. 9 shows the hinge-lid box according to FIG. 8 in the open position, FIG. 10 shows an illustration analogous to FIG. 2 for a further exemplary embodiment of a hinge-lid box, and FIG. 11 shows the hinge-lid box according to FIG. 10 in the open position.

The drawings concern the configuration of cigarette packs of the hinge-lid box type. A hinge-lid box comprises a blank made of thin cardboard for forming a box part 10 and a lid 11. The box part 10 has a box front wall 12, a box rear wall 13, box side walls 14, 15 and a base wall 16. Analogously, the lid 11 comprises a lid front wall 17, lid rear wall 18, lid side walls 19, 20 and a top end wall 21. The box part 10 and lid 11 are connected pivotably to one another by a transversely directed articulation line 22 in the region of the box rear wall 13 and lid rear wall 18. A collar 23 is arranged within the hinge-lid box. Said collar comprises a collar front wall 24 and collar side tabs 25, 26. The collar 23 is anchored, by way of a bottom sub-region, in the box part 10, namely on the inside of the box front wall 12 and/or of the box side walls 14, 15. A top sub-region of the collar 23 projects out of the box part 10. When the lid 11 is closed, this part of the collar 23 is enclosed by the lid 11 (FIGS. 1 and 2).

The collar 23 is configured in the conventional manner such that a cutout 27 bounded by an arcuately curved edge is formed in the region of the collar front wall 24, above the box front wall 12. Said cutout 27 is bounded laterally by upright ridges 28, 29 of the collar front wall 24.

The pack contents comprise a cigarette group which is (fully) enclosed by an inner wrapper 30. The cigarette group forms a cigarette block 31 with the inner wrapper 30. The inner wrapper 30 consists of tin foil, paper or film.

The inner wrapper 30 is folded around the cigarette group such that a top wall 32 (adjacent to the end wall 21) is formed from folding tabs, namely an outer tab 33 and an inner tab 34. The outer tab 33 merges into an (upright) front wall 35 of the inner wrapper 30. The top part of the latter forms a flap 36, that is to say a part of the inner wrapper 30 which can be pulled off or detached. When the cigarette pack is opened for the first time—with the lid 11 open—the flap 36 is pulled off from the inner wrapper 30, with the result that the cigarettes are exposed in the top front region for removal. The flap 36 may be divided off from the rest of the inner wrapper 30 by a punch line 37 or by a perforation line, or it may also be designed as a separate, independent blank. The hinge-lid box is accompanied by a thin-walled blank which consists of paper, sheet material or the like and has the function of a printing carrier or advertising carrier and is referred to hereinbelow as a coupon 38. The blank or the coupon 38 is designed as a rectangular blank and is positioned in the front part of the hinge-lid box, namely between the cigarette block 31, on the one hand, and the hinge-lid box, on the other hand. In the top region, the coupon 38 extends between the cigarette block 31 and collar 23.

In the box part 10, the coupon 38, as is shown in FIG. 1, can extend on the inside of the box front wall 12 as far as the base wall 16. A bottom end region of the coupon 38 may be designed conically here, that is to say with downwardly converging border edges, in order for the introduction of the coupon 38 into the pack to be facilitated. The coupon 38 is supported on the base wall 16. Alternatively, the coupon may be supported, by way of a bottom transverse border, on a protrusion of the collar 23 or the collar front wall 24, for example in accordance with DE 195 06 844.0.

A top region of the coupon 38 extends into the lid 11. The coupon 38 is fixed here. In the exemplary embodiment according to FIGS. 1 to 5, the coupon 38 is connected to the lid 11 by form-fitting engagement such that, when the lid is opened, the coupon is pulled some way out of the original position and thus passes into a position which is favorable for removal purposes.

In the preferred exemplary embodiment, the coupon 38 forms, in the top region, a stop which interacts in a form-fitting manner with a mating stop of the lid 11. Serving as the mating stop is a lid inner tab 39, which butts against the inside of the lid front wall 17 and is usually connected thereto by adhesive bonding. A transverse edge 40 of the lid inner tab 39 serves as a stop for the coupon 38.

Said coupon is provided with a leg 41 which is formed by being folded over. For this purpose, the coupon 38 may be provided, along a folding edge 42, with weakened material sections, for example a perforation line, in order to facilitate the folding-over operation of the leg 41. A free border edge 43 of the leg 41 forms the stop which interacts with the lid inner tab 39.

The coupon 38 is positioned within the hinge-lid box such that the folded leg 41 of the coupon 38 extends within the lid 11 and is directed toward the lid front wall 17. The leg 41 is located above the lid inner tab 39. The dimensions are coordinated with one another such that, in the starting position, the border edge 43 of the coupon 38 butts against the transverse edge 40 and/or is adjacent to the same. The form-fitting support is ensured by the restoring force of the leg 41 and the resulting reliable abutment against the lid front wall 17.

Opening of the hinge-lid box (for the first time) proceeds in accordance with the movement steps which can be gathered from FIGS. 3, 4 and 5. On account of the form-fitting connection to the lid front wall 17, the coupon 38 is pulled out of the box part when the lid 11 is opened. As the lid 11 is opened further, the form-fitting engagement of the coupon 38 with the lid front wall 17 is lost (FIG. 4). When the lid 11 is fully open, on account of material-induced restoring forces, a top region of the coupon 38, which projects out of the hinge-lid box, has returned into a (more or less) upright position (FIG. 5). The coupon 38 can then be easily gripped by the top, free part and pulled out of the hinge-lid box to the full extent.

The lid inner tab 39 and leg 41 of the coupon 38 are coordinated with one another in terms of dimensions in order to ensure mutual engagement. In the present exemplary embodiment, the lid inner tab 39 extends approximately over half the height of the lid front wall 17. Correspondingly, the leg 41 or the coupon 38 may extend more or less as far as the end wall 21. It is also possible for the proportions to be changed without the form-fitting engagement being lost. Furthermore, it is also possible for some other form of stop for the coupon 38 to be provided on the inside of the lid front wall 17, for example by a protrusion, on the inside of the lid inner tab 39, which is formed by stamping, punching or the like. In this case, the coupon 38 or the leg 41 thereof butts against a material protrusion of this type.

The coupon 38 is positioned in the box part 10 such that the leg 41 is folded over around the top boundary of the collar front wall 24, namely over the top ends of the ridges 28, 29. For fitting the coupon 38, it is possible to proceed in the manner illustrated in DE 195 06 844.0, the leg 41 being folded over around the ends of the ridges 28, 29 once the coupon 38 has been introduced.

The configuration and arrangement of the coupon 38 with a leg 41 also allows industrial production of a design according to FIGS. 6 and 7, in which the coupon 38 is fastened on the inside of the lid front wall 17 by adhesive bonding, namely by one or more spots of glue 44. This glue connection is formed in the region of the leg 41. In terms of production, the restoring force present in the leg 41 is also utilized here. The spot of glue 44 may be provided on the inside of the lid front wall 17 or on the leg 41. Once the leg 41 has been folded and the hinge-lid box completed, it is ensured that the leg 41 is forced against the lid front wall 17 and the glue connection is thus produced.

During handling of a hinge-lid box designed in this manner, the coupon 38, when the lid 11 is opened for the first time, is pulled out of the box part 10 (FIG. 7) and can then be released or detached from the lid.

A further special feature can be gathered from FIGS. 8 and 9. In this exemplary embodiment, the coupon 38 is connected to the cigarette block 31 or the inner wrapper 30, to be precise by one or more spots of glue 45. In specific terms, the coupon 38 is connected to the flap 36 of the inner wrapper 30, that is to say to the pull-off flap. In the exemplary embodiment according to FIGS. 8 and 9, the glue connection or the spot of glue 45 is connected in the region of the outer tab 33 of the top wall 32, that is to say to the folding tab adjoining the flap 36. By virtue of the coupon 38 being gripped—when the lid 11 is opened—the coupon 38 helps first of all to render the outer tab 33 in the upright position and then to pull the flap 36 out of its original position and/or to pull it off from the inner wrapper 30 (FIG. 9). The flap 36 is thus removed with the aid of the coupon 38.

The coupon 38 is positioned in a specific manner here. A transverse leg 46 extends in a plane above the top wall 32, for connection to the latter. An end tab 47 is folded onto the transverse leg 46 (in the starting position according to FIG. 4) and, when the lid 11 is open, said end tab, on account of the material-induced restoring forces, passes into an upright position (FIG. 9). The end tab 47 extends as far as the inside of the lid front wall 17 and/or butts with a small amount of pressure against the same, with the result that when the lid 11 is opened, the end tab 47 is additionally moved into the upright position.

It is also the case with the exemplary embodiment according to FIGS. 10 and 11 that the coupon 38 is connected to the inner wrapper 30. One or more spots of glue 48 are arranged in the region of an upright, front flap wall 49. The coupon 38 is designed and/or arranged such that the top wall 32 of the inner wrapper 30 is freely accessible. With this design, when the pack is opened for the first time, the flap 36 is removed in the conventional manner, namely with the aid of the outer tab 33. The coupon 38 is pulled out of the pack with said outer tab and/or with the flap 36 (FIG. 11). In this design, the flap 36 thus performs a double function.

| List of designations | |
|---|---|
| 10 | Box part |
| 11 | Lid |
| 12 | Box front wall |
| 13 | Box rear wall |
| 14 | Box side wall |
| 15 | Box side wall |
| 16 | Base wall |
| 17 | Lid front wall |
| 18 | Lid rear wall |
| 19 | Lid side wall |
| 20 | Lid side wall |
| 21 | End wall |
| 22 | Articulation line |
| 23 | Collar |
| 24 | Collar front wall |
| 25 | Collar side tab |
| 26 | Collar side tab |
| 27 | Cutout |
| 28 | Ridge |
| 29 | Ridge |
| 30 | Inner wrapper |
| 31 | Cigarette block |
| 32 | Top wall |
| 33 | Outer tab |
| 34 | Inner tab |
| 35 | Front wall |
| 36 | Flap |
| 37 | Punch line |
| 38 | Coupon |
| 39 | Lid inner tab |
| 40 | Transverse edge |
| 41 | Leg |
| 42 | Folding edge |
| 43 | Border edge |
| 44 | Spot of glue |
| 45 | Spot of glue |
| 46 | Transverse leg |
| 47 | End tab |
| 48 | Spot of glue |
| 49 | Flap wall |

What is claimed is:

1. A hinge-lid pack for cigarettes, comprising a box pan (10) and a lid (11) connected pivotably thereto, and a printing carrier or coupon comprising a separate blank being arranged within the pack and, when the lid (11) is closed, extending, by way of a sub-region, within the lid (11), characterized in that the coupon (38) is connected by adhesive bonding to a detachable flap (36) of an inner wrapper (30) which encloses a cigarette group, the coupon (38) is connected to an outer tab (33) of a front wall (35) of the inner wrapper (30), the outer tab (33) being part of the flap (36), and the coupon (38) has a transverse leg (46), which is directed parallel to the front wall (35) of the inner wrapper (30) and is intended for connecting to the outer tab (33), and an end tab (47), which is formed by being folded over and is intended for the purpose of gripping the coupon (38) when the lid (11) is open.

2. A hinge-lid pack for cigarettes, comprising a box part (10), a lid (11) connected pivotably thereto and a cigarette block (31), formed by a cigarette group wrapped in an inner wrapper (30), as the pack's contents, wherein:

a) the inner wrapper (30) has, in a region of the lid (11), a wrapper top wall (32) comprised of folding tabs, of which an outer folding tab (33) is connected to an upright front wall (35) of the inner wrapper (30), b) an upper part of the wrapper front wall (35) and the outer tab (33) define a detachable front flap (36) which is detachable along a punch line (37) in the wrapper front wall (35), c) arranged between the cigarette block (31) and a front wall (12) of the box part (10) is a printing carrier or coupon (38) made from a separate blank, d) the coupon (38) extends into a region of the wrapper flap (36), and e) the coupon (38) is connected by glue only to the flap (36).

3. The pack according to claim 2, wherein the coupon (38) is connected only to a front wall (49) of the flap.

4. The pack according to claim 2, wherein:

a) the coupon (38) has an angled transverse leg (46) which extends in a region of the wrapper top wall (32), and b) the coupon transverse leg (46) is connected by the glue to only the outer tab (33) as part of the flap (36).

5. The pack according to claim 4, wherein there is connected to the coupon transverse leg (46), as an extension of the coupon (38), a coupon end tab (47) which abuts the transverse leg (46) by being folded over and which can be gripped when the lid (11) is open.

6. The pack according to claim 2, wherein:

a) arranged in the box part (10) is a collar (23) which comprises a collar front wall (24) and collar side tabs (25, 26), b) the collar front wall (24) abuts an inner side of a front wall (12) of the box part (10), and c) the coupon (38) extends in a region of the collar (23) between the collar front wall (24) and the cigarette block (31).

7. The pack according to claim 2, wherein the coupon (38), in an original position thereof, extends to a base wall (16) of the box part (10).

8. The pack according to claim 2, wherein the coupon (38) is connected to the flap (36) or to the outer tab (33) by spots of the glue (45, 48).

* * * * *